US005432982A

United States Patent [19]

Van Ardenne-Van Rhijn

[11] Patent Number: 5,432,982

[45] Date of Patent: Jul. 18, 1995

[54] CLIP FOR RETAINING TOGETHER SHEETS OF PAPER OR OTHER MATERIALS

[75] Inventor: Johanna L. M. Van Ardenne-Van Rhijn, Voorschoten, Netherlands

[73] Assignee: Multibridge B.V., Voorschoten, Netherlands

[21] Appl. No.: 180,272

[22] Filed: Jan. 12, 1994

[30] Foreign Application Priority Data

Jan. 12, 1993 [NL] Netherlands ..... 9300056

[51] Int. Cl.[6] ..... B42F 1/02

[52] U.S. Cl. ..... 24/67.9; 24/545; 24/563

[58] Field of Search ..... 24/67.9, 67 R, 67.3, 24/67.11, 545, 563

[56] References Cited

U.S. PATENT DOCUMENTS

| | | | |
|---|---|---|---|
| 1,070,683 | 8/1913 | Hale | 24/563 |
| 1,493,072 | 5/1924 | Fricker . | |
| 1,637,564 | 8/1927 | Gillette . | |
| 1,713,994 | 5/1929 | Carter et al. | 24/67.9 |
| 2,116,365 | 5/1938 | Schafer | 24/545 |
| 2,478,376 | 8/1949 | De Swart . | |
| 3,125,789 | 3/1964 | Parker | 24/67.9 |
| 4,947,524 | 8/1990 | Chang . | |
| 5,136,754 | 8/1992 | Kuroda . | |

FOREIGN PATENT DOCUMENTS 361031 5/1906 France .

*Primary Examiner*—Victor N. Sakran
*Attorney, Agent, or Firm*—Edmund M. Jaskiewicz

[57] ABSTRACT

A clip for retaining together sheets of paper or other materials comprising a single thin strip of resilient sheet-like material bent upon itself to define an end fold and first and second holding legs each having first and second upper ends respectively interconnected at said end fold, said first and second holding legs each having first and second lower ends respectively opposite said end fold and said lower ends intersecting at an angle with respect to each other so as to define a reverse V-shaped push-on space and wherein at the position where the two push-on edges cross each other a space is created between the legs as a result of the fact that at least one of the clamping legs is provided with a non-angular depression.

6 Claims, 1 Drawing Sheet

CLIP FOR RETAINING TOGETHER SHEETS OF PAPER OR OTHER MATERIALS

FIELD OF THE INVENTION

The invention relates to a clip for retaining together sheets of paper or other materials comprising a single thin strip of resilient sheet-like material bent upon itself to define an end fold and first and second holding legs each having first and second upper ends respectively interconnected at said end fold, said first upper end defining a small angle $\alpha$ with said second upper end, said first leg having a bend spaced from said end fold so as to define said first upper end there-between, said first leg further having a central portion adjoining said bend and said central portion defining an obtuse angle $\beta$ with said first upper end at said bend such that said first upper end, said bend and said central portion are spaced from said second folding leg, said first leg having a lower portion extending from said central portion and biased flatly against said second leg, said first and second holding legs each having first and second lower ends respectively opposite said end fold and said lower ends intersecting at an angle with respect to each other so as to define a reverse V-shaped push-on space, said first and second lower ends each terminating in a single rounded point.

STATE OF THE ART

A clip as defined above constitutes the subject of my U.S. patent application Ser. No. 07/922 544.

It has a large number of advantages over existing prior clips, and in particular clips for paper. The main advantages are that virtually all positive features of the staple and the known paper clip made of steel wire are combined, while all disadvantages of these two are eliminated. It has a much greater clamping force than all known clips, due to the fact that it has a broad, flat clipping area between the two clamping legs which, as a result of the bias force resulting from the way in which the clip is bent, will remain flat up to a much greater thickness of the clipped sheets than is the case with other clips. Partly as a result of this, the increase in the thickness of the clipped pile, which becomes a nuisance when several piles clipped together are laid on top of one another, is very limited. In use, it does not cause damage to the material on which it is being used. The clip is also easy to print on, so that it can be used as a carrier of advertising messages. Moreover, the clip is naturally easy to slide into position. This ease of sliding is improved even further if, as described in the older patent application, the push-on edges are rounded. The die-cutting can be carried out in such a way that this rounding occurs automatically.

OBJECT OF THE INVENTION

It is in the field of this ease of push-on that the present invention intends to propose a further improvement.

SUMMARY OF THE INVENTION

The clip according to the present invention is characterized in that at the position where the two push-on edges cross each other a space is created between the legs, as a result of the fact that at least one of the clamping legs is provided with a non-angular depression.

This space can be used at the start of pushing of the clip onto the pile to be clipped. Said pile will then start to move in between the clip legs without any friction.

On continuation of this pushing-on or sliding movement, there is then in particular no risk of any damage to the edge of the paper. If the pile is small compared with the pile thickness corresponding to the maximum capacity of the clip, the push-on movement can even start while the clip is being held virtually in the same plane as the pile onto which it is to be pushed. In the case of greater pile thicknesses, coming closer to the capacity of the clip, it is desirable to turn the clip through a small angle at the start of the push-on movement, so that one point lies at the back and the other at the front of the pile, while said angle will disappear again by itself as the clip is pushed further onto the pile.

The idea of the invention is most effective if a line of symmetry extends from the depressed part in one clamping leg in the direction of the push-on edge of the other clamping leg.

Since the depression according to the basic idea of this invention inevitably leads to a decrease in the overall clamping surface of the two legs, it is advantageous if said decrease is limited. This is achieved in an embodiment in which the depressed part extends in the direction of the push-on edge of the other clamping leg to no more than half the distance from the side edge of the clip.

Otherwise, it is sufficient for only one depression to be provided in the clamping leg in which the bend is provided. This is the leg which in practice is indicated as the rear leg, because the other leg, in which no fold zone or bend at all is then present, will accommodate at least the major part of a printed message. The depression according to the present invention and said printing thus do not impede one another.

The invention will be explained below with reference to the appended drawing of a preferred embodiment.

DESCRIPTION OF THE PREFERRED EMBODIMENT

Figures 1, 2, 3, 4, 5:
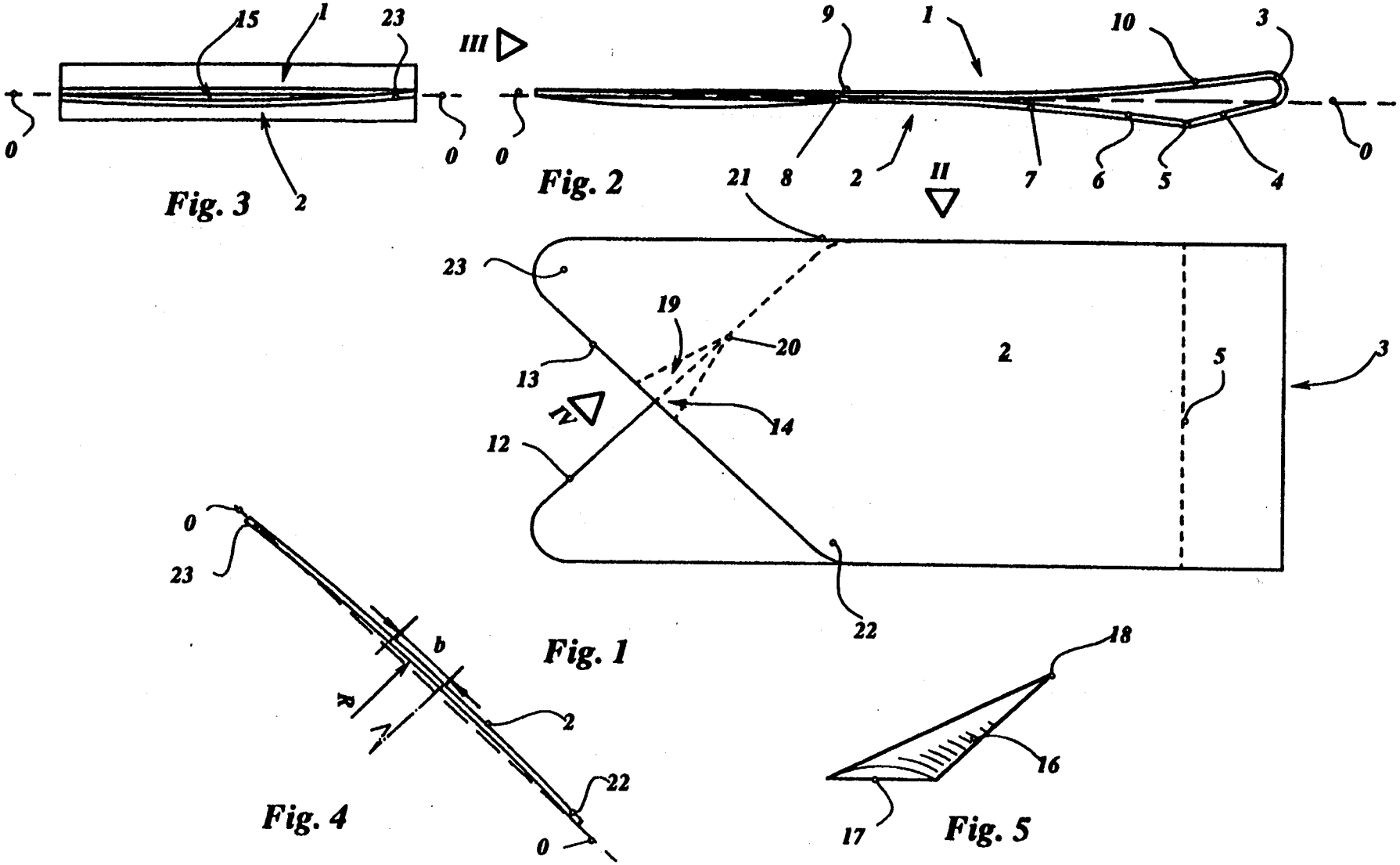
FIG. 1 shows the clip in a view looking towards the clamping leg in which the bend is provided.
FIG. 2 shows a side view in the direction of the arrow II in FIG. 1.
FIG. 3 shows an end view at the side of the push-on edges, according to the arrow III in FIG. 3.
FIG. 4 shows a view according to the arrow IV in FIG. 1 solely in the direction of the push-on edge of the clamping leg in which the bend is provided.
FIG. 5 serves to illustrate the shape of the depression according to the invention in the preferred embodiment shown.

For the sake of simplicity, the same reference numbers are used in the figures as those found in U.S. Ser. No. 07/922544. FIGS. 1 and 2 thus show a clip which is intended in particular for holding together sheets of paper, comprising two clamping legs 1 and 2 made of sheet material, which are movable resiliently relative to each other. The end edges 12, 13 of the clamping legs cross each other at an angle which in the preferred embodiment shown is a right angle, and in use said end edges 12 and 13 form push-on edges which define a substantially V-shaped push-on space.

The legs 1 and 2 are connected to each other at the place 3 with a rounded zone, in such a way that the part 4 of the clamping leg 2 directly adjacent thereto lies at a distance from the part 10 of clip leg 1 adjacent to the connecting zone 3. In this way space is formed for the sheets onto which the clip is to be pushed. The parts 4 and 10 form an acute angle between them. In leg 2, a bend is also provided at position 5, in such a way that an obtuse angle is produced between the part 4 and the part 6 of leg 2 at the other side of said bend line, which obtuse angle is at least 145°, and preferably lies between 145° and 160°. This bend and the abovementioned selection of the obtuse angle ensure that the remaining part 8 of the leg 2 from the point indicated by 7 onwards will lie substantially flat against the inside of the other part 9 of clamping leg 1, as a result of the bias-force arising as a result of bending according to the abovementioned angle value.

For a good understanding of the present invention, a reference plane or zero plane is indicated by 0 in the drawings. This is the contact face of the parts 8 and 9 of the two clamping legs, where they touch each other fully, thus from the point indicated by 7 in FIG. 2 up to the ends.

According to the invention, at the position of the crossing point 14 (see FIG. 1) of the two push-on edges 12, 13, a space 15 (see FIG. 3) is created between said push-on edges, in order to facilitate pushing of the clip onto the pile. The height of said space—height defined as the dimension in the direction at right angles to the plane of the clip legs 1, 2—is preferably once the thickness of the sheet material from which the clip is made. The space is produced by providing at least one of the legs—leg 2 in the embodiment shown and described—with a non-angular depression.

For the description of the shape of this depression, reference is first made to the auxiliary FIG. 5. This figure shows schematically the shape of an element in the sheet working tool which is used for making the depression. Here we see a part of a circumferential plane 16 of a circular cylinder whose axis (not shown) forms a small angle with the plane of the undeformed material, with the result that the part of the circular cylinder projecting beyond said plane decreases in height from the end 17 to the point 18. For the sake of clarity, FIG. 5 shows the width and the height of the element enlarged in relation to the dimensions in the other figures, while the radius of curvature of the cylinder is in fact greatly reduced. In reality, the radius of curvature of the imaginary cylinder is very great: at least a multiple of, for example, the width measurement of the clip; in an actual embodiment of the clip a radius of curvature which is approximately nine times the width of the clip is used. The width of the depression at the position of the end edge 13 is shown in FIG. 4, indicated by b. In the embodiment shown, this width is approximately 20% of the width of the clip.

The depression according to the invention is thus produced in the triangular region indicated by 19 in FIG. 1. It is important to keep this region relatively small, in so far as the depression reduces the contact face of the clamping legs, while one of the advantages of the original clip lies in the fact that the full contact face always remains, even when it is placed on relatively thick piles of paper. If the region 19 is limited in the manner shown in FIG. 1, the decrease in the surface of the contact face is small and, above all, hardly perceptible to the eye of the ordinary user. The yardstick applied can be that the end point 20 of the deformed region 19 lies at a position which is one third to at most half the distance between the point 14 and the side edge 21 of the clip at the place where the extension of the push-on edge 12 reaches said side edge. Otherwise, if it is considered important, the decrease in the contact surface can easily be compensated for by a very slight increase in the length of the clip.

It is also pointed out that the deformation over the region with width b, while the sheet material of the clip part 2 lying outside that remains undeformed, in the view towards the push-on edge 13—in FIG. 4 the view directly towards the push-on edge 13, thus at 45° relative to the lengthwise direction of the clip, and in FIG. 3 directly towards the clip and at 45° relative to the direction of the push-on edge 13—leads to a space with a width which is much greater than the width b of the actually deformed region. This is, of course, due to the fact that the sheets rest against each other at the points arising from the shaping. Therefore, it can be seen in FIG. 4 that the leg 2 on the right, at point 22 where it is still resting against leg 1, remains on the zero line, while on the left near point 23, which is free from contact with the leg 1, it passes through the zero plane as a result of the deformation within the zone b. Of course, the same can be seen also in FIG. 3.

The idea of the invention can also be applied to any clip with push-on edges defining a V-shaped push-on space.

What is claimed is:

1. A clip for retaining together sheets of paper or other materials comprising a single thin strip of resilient sheet-like material bent upon itself to define an end fold and first and second holding legs each having first and second upper ends respectively interconnected at said end fold, said first upper end defining a small angle $\alpha$ with said second upper end, said first leg having a bend spaced from said end fold so as to define said first upper end there-between, said first leg further having a central portion adjoining said bend and said central portion defining an obtuse angle $\beta$ with said first upper end at said bend such that said first upper end, said bend and said central portion are spaced from said second folding leg, said first leg having a lower portion extending from said central portion and biased flatly against said second leg, said first and second holding legs each having first and second lower ends respectively opposite said end fold and said lower ends intersecting at an angle with respect to each other so as to define a reverse V-shaped push-on space, said first and second lower ends each terminating in a single rounded point, and wherein at the position where the two push-on edges cross each other a space is created between the legs as a result of the fact that at least one of the clamping legs is provided with a non-angular depression.

2. A clip as in claim 1, wherein a line of symmetry extends from the depressed part in one clamping leg according to the direction of the push-on edge of the other clamping leg.

3. A clip as in claim 2, wherein a line of symmetry extends from the depressed part in one clamping leg according to the direction of the push-on edge of the other clamping leg and said depressed part extends according to the direction of the push-on edge of the other clamping leg, to no more than half the distance from the side edge of the clip.

4. A clip as in claim 1, wherein said depression has been formed in accordance with a part of the circumferential face of a circular cylinder whose axis forms a small angle with the plane of the unde-formed material, and having a radius of curvature which is a multiple of the width of the clip.

5. A clip as in claim 1, wherein said space created between the clip legs by said depression has a height which is substantially equal to the thickness of the sheet material from which the clip has been made.

6. A clip for retaining together sheets of paper or other materials comprising a single thin strip of resilient sheet-like material bent upon itself to define an end fold and first and second holding legs each having first and second upper ends respectively interconnected at said end fold, said first upper end defining a small angle $\alpha$ with said second upper end, said first leg having a bend spaced from said end fold so as to define said first upper end there-between, said first leg further having a central portion adjoining said bend and said central portion defining an obtuse angle $\beta$ with said first upper end at said bend such that said first upper end, said bend and said central portion are spaced from said second folding leg, said first leg having a lower portion extending from said central portion and biased flatly against said second leg, said first and second holding legs each having first and second lower ends respectively opposite said end fold and said lower ends intersecting at an angle with respect to each other so as to define a reverse V-shaped push-on space, said first and second lower ends each terminating in a single rounded point, and wherein at the position where the two push-on edges cross each other a space is created between the legs as a result of the fact that the clamping leg in which the bend is provided, has a non-angular depression.

* * * * *